United States Patent [19]

Tricon

[11] 4,373,639

[45] Feb. 15, 1983

[54] SUPPORTIVE ANGLE HOLDING MEANS AND STRUCTURE CLAMPING MEANS FOR STORAGE DEVICES

[76] Inventor: Alfred J. Tricon, 9654 Winsome La., Houston, Tex. 77063

[21] Appl. No.: 169,290

[22] Filed: Jul. 16, 1980

[51] Int. Cl.[3] ..... A47F 7/00

[52] U.S. Cl. ..... 211/86; 108/28; 211/13; 248/226.3

[58] Field of Search ..... 211/86, 13, 88, 69.1; 248/441 B, 441 C, 225.3, 316 C, 229, 226.3; 108/28

[56] References Cited

U.S. PATENT DOCUMENTS

| | | | |
|---|---|---|---|
| 224,687 | 2/1880 | Hewes | 248/441 C X |
| D. 256,754 | 9/1980 | LoJacono et al. | 248/441 C X |
| 368,388 | 8/1887 | Drake | 248/441 C X |
| 1,282,489 | 10/1918 | Strodel | 248/441 C X |
| 1,505,803 | 8/1924 | Pylick . | |
| 1,658,838 | 2/1928 | Early . | |
| 2,827,176 | 3/1958 | Ready | 108/28 |
| 2,846,808 | 8/1958 | Ivester . | |
| 3,142,129 | 7/1964 | Stroop . | |
| 3,207,317 | 9/1965 | Moore et al. | 211/13 |
| 3,273,846 | 9/1966 | De Mare' | 211/69.1 X |
| 3,647,078 | 3/1972 | Fortunato | 211/134 |
| 3,744,645 | 7/1973 | Hochman | 211/126 |
| 4,113,218 | 9/1978 | Linder | 211/86 X |

*Primary Examiner*—Roy D. Frazier
*Assistant Examiner*—Robert W. Gibson, Jr.

[57] ABSTRACT

The present invention provides level positioning for storage devices used by draftsmen, illustrators, painters, etc of a universal and secure nature, providing for most mounting structure sizes and angles, left or right mounting, of simplicity which provides low cost and utility not available in nearly forty years of drawing experience and manufacturing observance.

6 Claims, 4 Drawing Figures

SUPPORTIVE ANGLE HOLDING MEANS AND STRUCTURE CLAMPING MEANS FOR STORAGE DEVICES

Various storage devices such as trays, boxes, grooves, etc are used by draftsmen, illustrators, and others whose working surface angle may vary from horizontal to near vertical; painters and machinists also find such devices needed; and most find supportive structure inherrent in their equipment at many angles and varying thickness but find no interconnecting devices to support their storage devices while being easily adaptable to their equipment situation and suitably rigidly supporting.

The present invention relates to a three element leveling and level locking means for integral incorporation within storage devices and adjustable structure clamping means to support the foregoing leveling means to clamp the whole to the structure the user desires.

Figure 1:
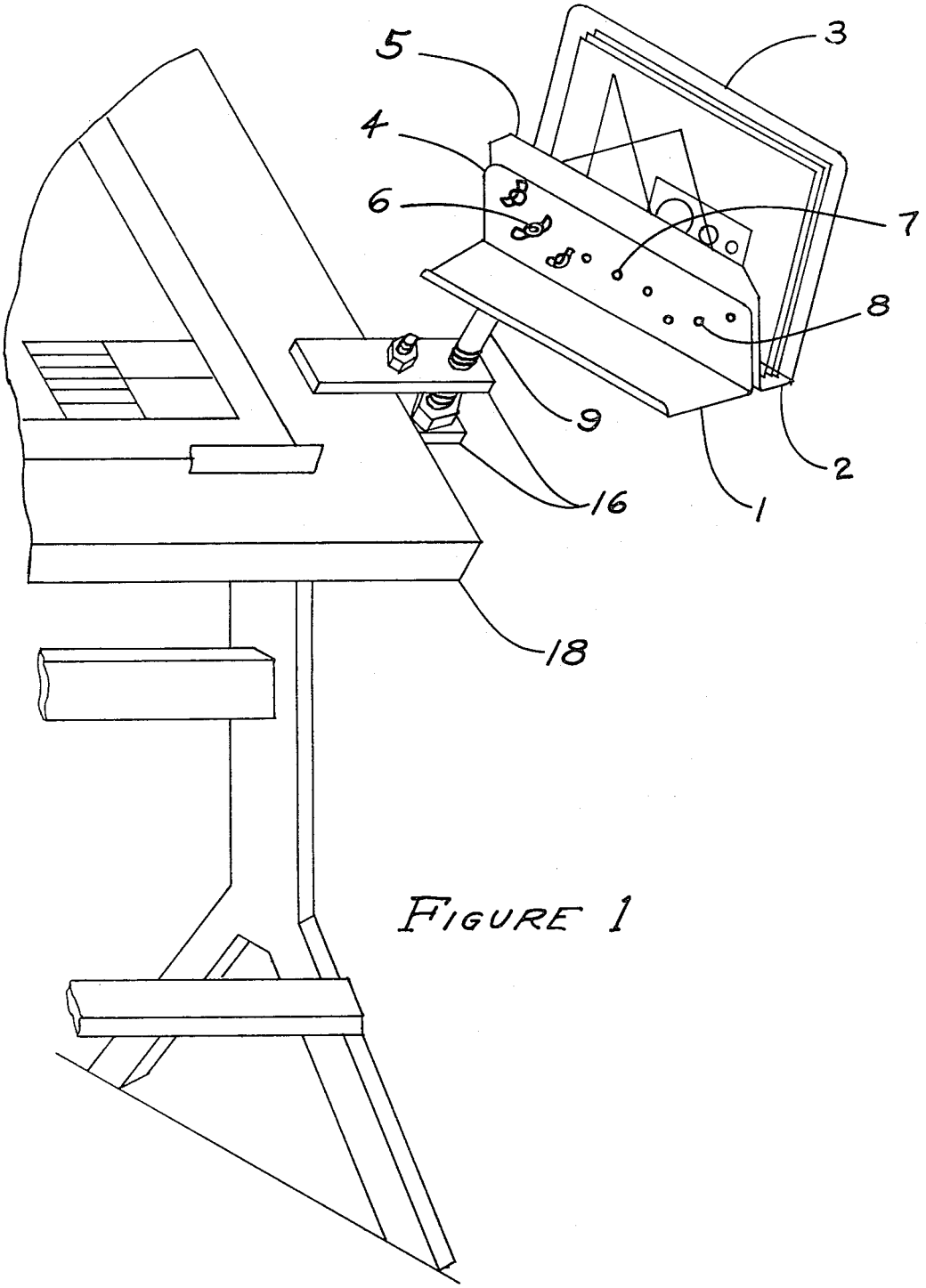
FIG. 1 is a perspective view of the device as it would be installed on a drawing board whose angle is about 30° for right hand installation.

In FIG. 1 are shown previous art, a shelf Item 1 and a trough Item 2. The trough is provided with a wall Item 3 inclined from vertical to allow flat material and objects to be biased against the wall by gravity.

Figure 2:
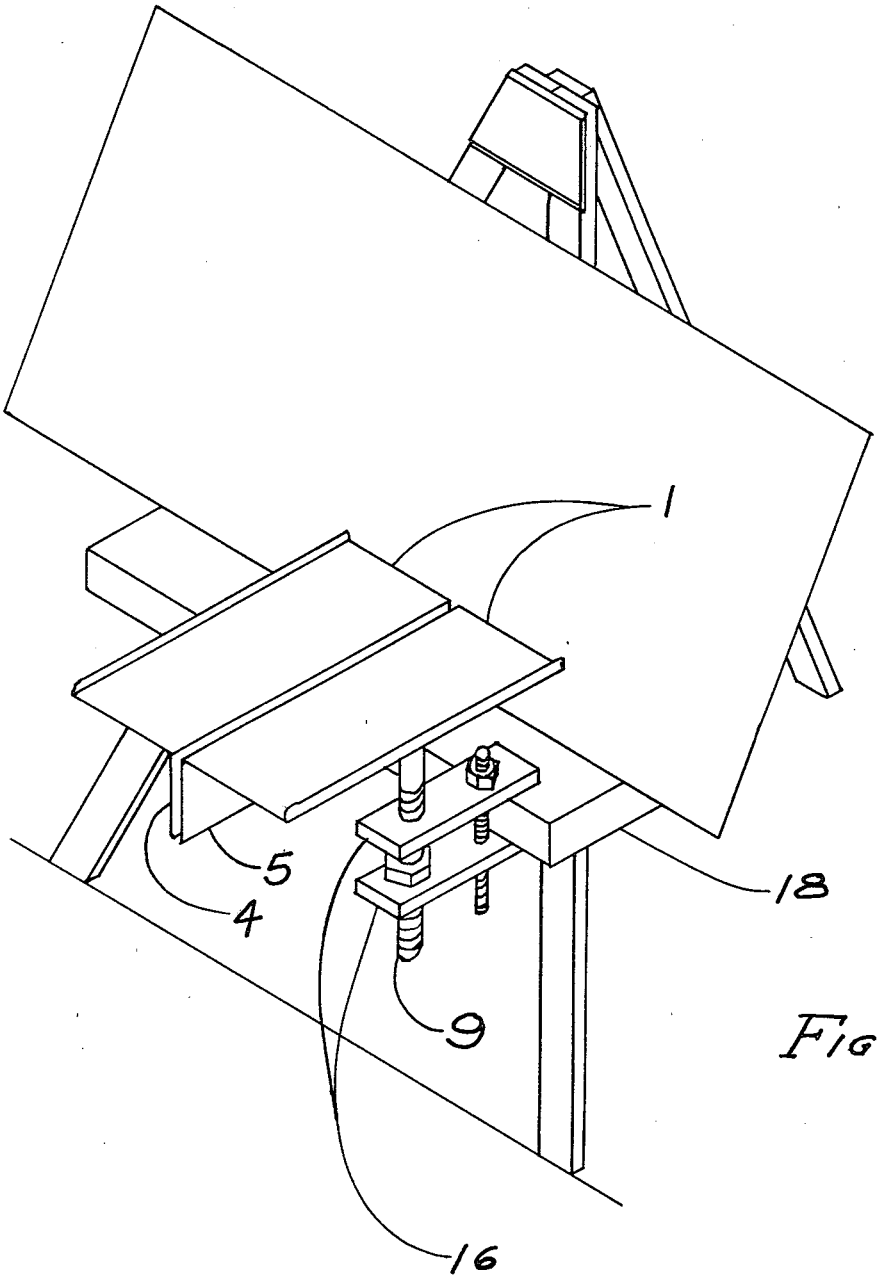
FIG. 2 is a perspective view if clamped to an easel.

The shelf and trough are provided with vertical walls Items 4 and 5, which project upwardly as shown in FIG. 1 and downwardly in FIG. 2.

Figure 4:
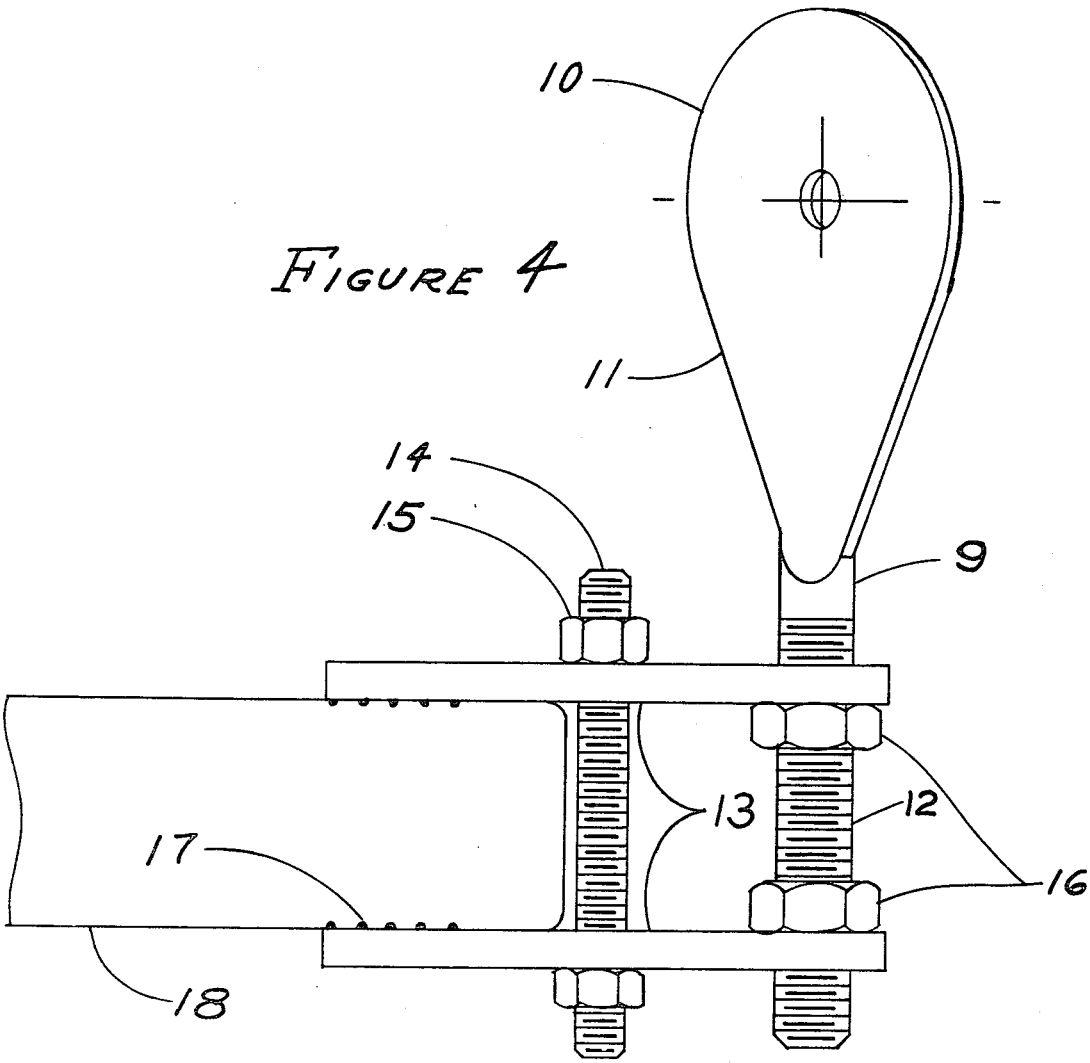
FIG. 4 illustrates the structure clamping mechanism.

The walls Items 4 and 5 are provided with hole patterns, Items 6, 7, and 8 providing three possible locations, which may be seen more functionally in FIG. 4. These walls provide the outer elements of a three element supportive and clamping angling means whose third center element is a major supportive structure Item 9. Only one of Item 9 is used per unit.

Figure 3:
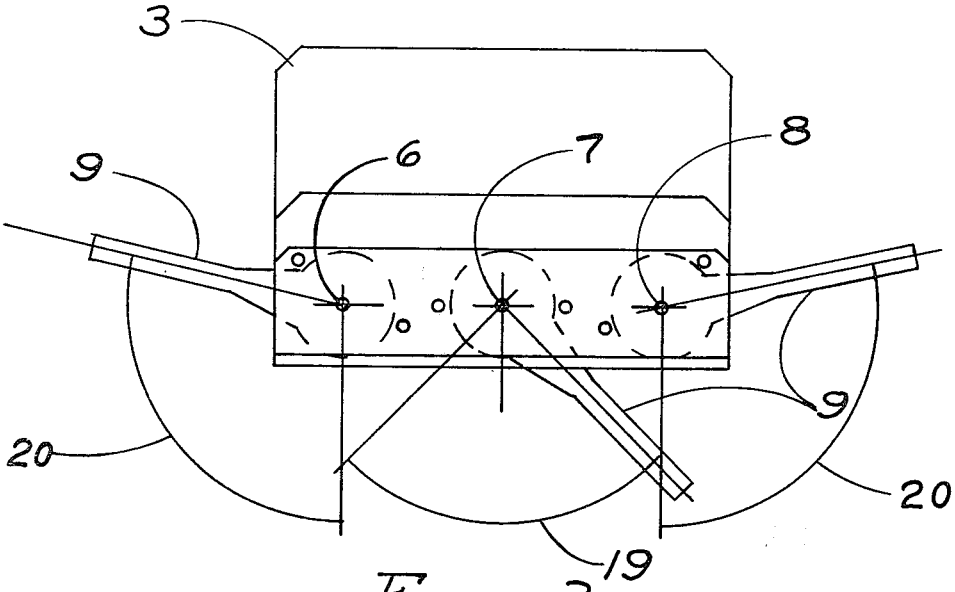
FIG. 3 is an orthographic view indicating the angular range capability for each of the three locations.

In FIG. 4 Item 9 is seen to be provided with a thin flat geometry on its top comprised of a circular section Item 10, which is integral with a truncated section Item 11. The flatness of Items 10 and 11 provide that Item 9 may be positioned thru an infinite number of angles when located in the hole patterns Items 6, 7, and 8, as shown in FIG. 3. When the unit is mounted on a structure whose angle is between horizontal and 45° Item 19, Item 9 may be installed in pattern Item 7; for mounting on structures whose angles exceed 45° Item 20, Item 9 is installed in pattern Item 6 for right hand use, and pattern Item 8 for left hand use.

The proportioning of the walls Items 4 and 5, the washer geometry Item 10, the hole patterns Items 6, 7, and 8, are such to provide a high mechanical clamping moment which in turn provides the desired level angle stability.

FIG. 4 shows that the major supportive structure Item 9 is provided with an integral lower rod Item 12 whose lower end is threaded and provided with two nuts Item 16.

FIG. 4 shows an all threaded tension rod Item 14 which is provided with two nuts Item 15; two similar beam clamp bars Item 13 each of which is provided with holes for the passage of Items 12 and 14, and with gripping projections Item 17 for high traction engagement with the structure Item 18 to which the clamp is clamped.

In FIG. 4 it is noted that the threaded rods Items 12 and 14 are suitable to accomodate large variations in thickness of structure.

In FIG. 4 it is noted that the placement of nuts Items 15 and 16 with respect to clamp bars Item 13 are such that they provide tension in rod Item 14 and compression in rod Item 12 such that clamping force is provided on structure item 18.

Clamp bars Item 13 are provided with proportional geometry such as to provide the desired rigidity through high clamp force.

The combination of the embodiment of high angle accomodations Items 19 and 20, rigid clamping means FIG. 4, the previously mentioned high structure clamping, all combine to provide location integrity of the whole storage device and are fundamentally necessary due to the variety of structure and location situations encountered by users.

What is claimed is:

1. An apparatus for tiltably connecting a storage device to a drafting table and the like, comprising:

a first threaded rod member, a second threaded rod member aligned with and spaced from said first rod member and having an eye portion at one end, a first bar member slidably disposed about said rod members, a second bar member slidably disposed about said rod members and alignedly spaced from said first bar member, a first pair of nut members each threadedly and compressively disposed on said first rod member for urging one of said bar members toward the other of said bar members, a second pair of nut members each threadedly and tensionally disposed on said second rod member for urging one of said bar members from the other of said bar members, support means for storing and holding selected objects, and connector means for pivotally interconnecting said support means with said eye portion of said second rod member for positioning said support means independently relative to the positions of said first rod member and said bar members.

2. The apparatus described in claim 1, wherein said first nut members are disposed to apply compression within and along the longitudinal axis of said first rod member adjacent the center portions of said bar members, and wherein said second nut members are disposed to exert tension within and along the longitudinal axis of said second rod member adjacent one of the end portions of each of said bar members.

3. The apparatus as described in claim 2, wherein said second nut members are further disposed on said second rod member for driving said bar members pivotally of said first nut members and into engagement with said drafting table and the like.

4. The apparatus as described in claim 3, wherein said bar members each having gripping surfaces at their end portions opposite said second nut and rod members for grippingly engaging adjacent surface portions of said drafting table and the like.

5. The apparatus as described in claim 4, wherein said second rod member and eye portion extends longitudinally of the adjacent end portion of said first rod member for spacing said support means from said drafting table and the like.

6. The apparatus described in claim 5, wherein said support means comprises a first tray member and the like having at least one aperture therein, a second tray member and the like having at least one aperture therein aligned with said aperture in said first tray member, and bolt member disposed in said apertures and said eye portion of said second rod member for fixedly supporting said tray members relative to said drafting table and the like.

* * * * *